US009359745B2

(12) United States Patent
Serrurier et al.

(10) Patent No.: US 9,359,745 B2
(45) Date of Patent: Jun. 7, 2016

(54) BUCKET EDGE PROTECTION SYSTEM

(71) Applicant: CATERPILLAR INC., Peoria, IL (US)

(72) Inventors: Douglas Charles Serrurier, Morton, IL (US); Arun Kumar Venugopal, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 182 days.

(21) Appl. No.: 14/054,564

(22) Filed: Oct. 15, 2013

(65) Prior Publication Data

US 2015/0101218 A1 Apr. 16, 2015

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01)

(58) Field of Classification Search
CPC ..... E02F 9/2816; E02F 9/2883; E02F 3/40
USPC ..... 37/451
See application file for complete search history.

(56) References Cited

U.S. PATENT DOCUMENTS

| | | | | |
|---|---|---|---|---|
| 1,944,307 | A | 1/1934 | Spoon | |
| 3,736,664 | A | 6/1973 | Black et al. | |
| 3,851,413 | A * | 12/1974 | Lukavich | 37/451 |
| 3,914,885 | A | 10/1975 | Moreau et al. | |
| 5,016,365 | A | 5/1991 | Robinson | |
| 5,210,965 | A | 5/1993 | Funk et al. | |
| 5,261,170 | A | 11/1993 | Ward | |
| 5,396,963 | A | 3/1995 | Curry | |
| 5,412,885 | A | 5/1995 | Cornelius | |
| 5,526,592 | A | 6/1996 | Bierwith et al. | |
| 5,634,285 | A | 6/1997 | Renski | |
| 6,186,245 | B1 | 2/2001 | Skjaeveland | |
| 6,240,663 | B1 * | 6/2001 | Robinson | 37/458 |
| 8,024,874 | B2 | 9/2011 | McCanahan et al. | |
| 8,959,807 | B2 * | 2/2015 | LaHood et al. | 37/455 |
| 2004/0031175 | A1 * | 2/2004 | Hohmann et al. | 37/446 |
| 2004/0060209 | A1 | 4/2004 | Watanabe | |
| 2005/0132619 | A1 | 6/2005 | Robinson | |
| 2005/0172524 | A1 * | 8/2005 | Grant | 37/446 |
| 2007/0022640 | A1 | 2/2007 | Jones et al. | |

FOREIGN PATENT DOCUMENTS

| | | |
|---|---|---|
| EP | 0215802 | 11/1989 |
| WO | WO 2010049546 | 5/2010 |

* cited by examiner

*Primary Examiner* — Robert Pezzuto
*Assistant Examiner* — Jessica H Lutz
(74) *Attorney, Agent, or Firm* — Procopio, Cory, Hargreaves & Savitch LLP

(57) ABSTRACT

An edge protection segment for an edge protection system of a ground engaging implement is disclosed. The edge protection segment includes a first side, a second side, a width, a wedge portion, an exterior leg, and an interior leg. The second side is oppositely disposed and lateral to the first side. The width is up to 6 centimeters and is the distance between the first side and the second side. The exterior leg and the interior leg each extend from the wedge portion. The wedge portion, the exterior leg and the interior leg each extend between the first side and the second side.

18 Claims, 3 Drawing Sheets

BUCKET EDGE PROTECTION SYSTEM

TECHNICAL FIELD

The present disclosure generally pertains to earth working machines with ground engaging implements, and is more particularly directed toward an edge protection system of a bucket for earth working machines.

BACKGROUND

Earth working machines known in the art are used for digging into the earth or rock and moving loosened work material from one place to another at a worksite. These machines and equipment typically include ground engaging implement, such as a bucket provided with a beveled lip or blade on a base edge for moving or excavating dirt or other types of work material. The bucket often includes ground engaging tools such as tooth assemblies and edge protectors. Tooth assemblies are typically spaced apart and project forward from the base edge. Edge protectors are used between the tooth assemblies to protect the base edge of the bucket from wear during use.

U.S. Pat. No. 5,016,365 to H. Robinson is directed to an improved wear assembly for a ground engaging tool, such as an excavator bucket, comprising a lip protector shroud which is detachably mounted on the bucket lip to cover the lip and provide a wear bearing surface that covers the lower surface of the tooth adapter and which is detachably held in place by abutment against a tooth detachably mounted on the adapter and a flexible pin extending through registering apertures in the adapter and the shroud.

The present disclosure is directed toward overcoming one or more of the problems discovered by the inventors or that is known in the art.

SUMMARY OF THE DISCLOSURE

An edge protection segment for an edge protection system of a ground engaging implement for an earth working machine is disclosed. The ground engaging implement includes a wrapper plate, an edge plate with a base edge, an interior surface, an exterior surface, and a base bevel. The base bevel includes a bevel surface adjacent the base edge and the interior surface. The ground engaging implement also including tooth assemblies configured to attach to the edge plate at the base edge. The tooth assemblies are spaced apart along the base edge.

The edge protection segment includes a first side, a second side, a width, a wedge portion, an exterior leg, and an interior leg. The second side is oppositely disposed and lateral to the first side. The width is up to 6 centimeters and is the distance between the first side and the second side. The wedge portion is a triangular prism shape extending between the first side and the second side. The wedge portion includes a leading edge and an edge mating surface. The leading edge is at a vertex of the triangular prism shape. The edge mating surface is opposite the leading edge, extending between the first side and the second side. The exterior leg extends from the wedge portion between the first side and the second side. The exterior leg includes an exterior mating surface adjacent to the edge mating surface.

The interior leg extends from the wedge portion between the first side and the second side. The interior leg includes a bevel portion and an end portion. The bevel portion extends from the wedge portion, angled away from the exterior leg.

The bevel portion includes a bevel mating surface adjacent edge mating surface. The end portion extends from the bevel portion. The end portion includes an interior mating surface offset from and facing the exterior mating surface and adjacent the bevel mating surface. The bevel mating surface is canted relative to the interior mating surface.

DETAILED DESCRIPTION

The systems and methods disclosed herein include a universal edge protection system of a ground engaging implement, such as a bucket, for earth working machines. In embodiments, the universal edge protection system includes multiple edge protection segments interlocked and bonded to the bucket. Each edge protection segment is selected from edge protection segments of predetermined widths to cover the base edge gap between two tooth assemblies extending from the base edge of the bucket, while maintaining a minimum clearance from each tooth assembly. The universal edge protection system may be used to shroud base edge gaps of varying lengths, may be lighter and easier to handle than one large piece of material, and may not need to be cut down to fit the base edge gaps.

Figure 1:
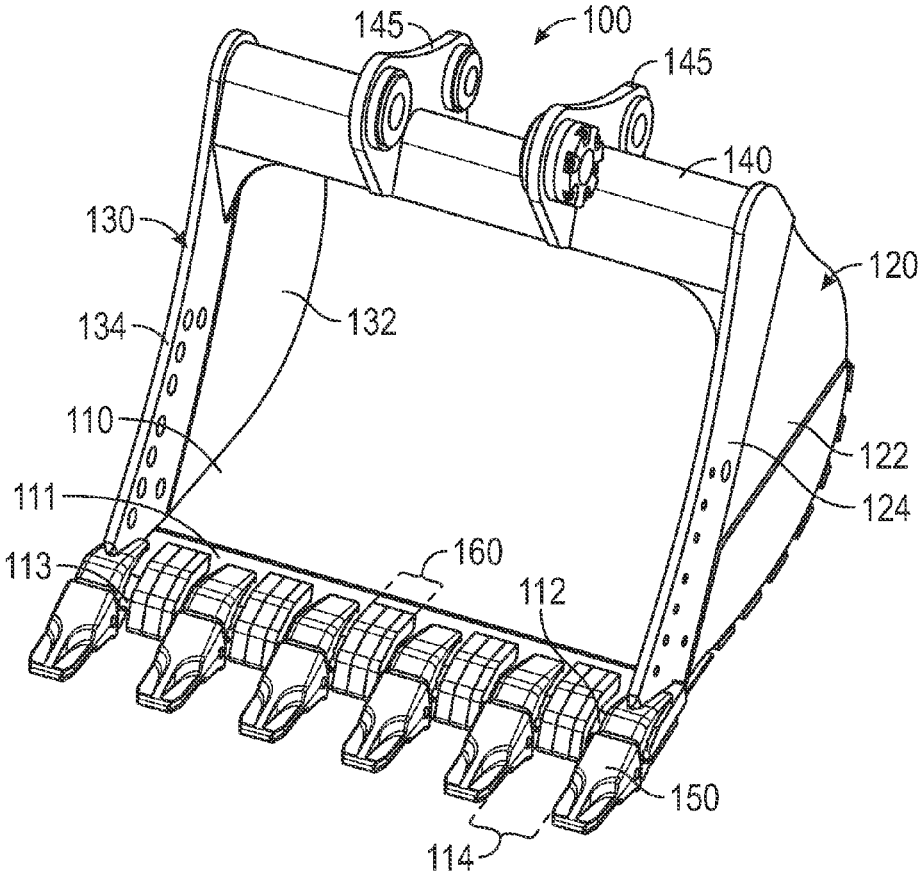
FIG. 1 is a perspective view of a bucket for earth working machines.

FIG. 1 is a perspective view of a bucket 100 for earth working machines. The earth working machines may be excavation equipment such as backhoes, loaders, and excavators. Bucket 100 includes wrapper plate 110, edge plate 111, first side wall 120, second side wall 130, tooth assemblies 150, and edge protection systems 160. Wrapper plate 110 may be a curved portion of bucket 100. Edge plate 111 is adjacent wrapper plate 110 and may be metalurgically bonded or welded to wrapper plate 110. Edge plate 111 may include a base edge 113 at one end of edge plate 111. Base edge 113 extends across edge plate 111 and is configured to be the leading edge of edge plate 111. The first side wall 120 connects to one side of wrapper plate 110 and edge plate 111, and the second side wall 130 connects to the other side of wrapper plate 110 and edge plate 111. First side wall 120 may include first side bar 124 and first side plate 122, and second side wall 130 may include second side bar 134 and second side plate 132. Each side bar may extend from base edge 113 to the edge of wrapper plate 110 opposite edge plate 111. Each side plate may extend between the corresponding side bar and side of wrapper plate 110.

Each tooth assembly 150 may include an adapter portion 152 and a tooth portion 151. The adapter portion 152 connects each tooth assembly 150 to edge plate 111 at base edge 113. The tooth portion 151 couples to adapter portion 152 and extends from base edge 113 away from edge plate 111. Tooth assemblies 150 are spaced apart along base edge 113 forming base edge gaps 114 there between.

Bucket 100 may also include torque tube 140 and hinge plates 145. Torque tube 140 may extend between first side bar 124 and second side bar 134 distal to base edge 113. Hinge plates 145 may be connected to torque tube 140. Hinge plates 145 may be configured to connect bucket 100 to the arm or stick of an earth working machine.

Figure 2:
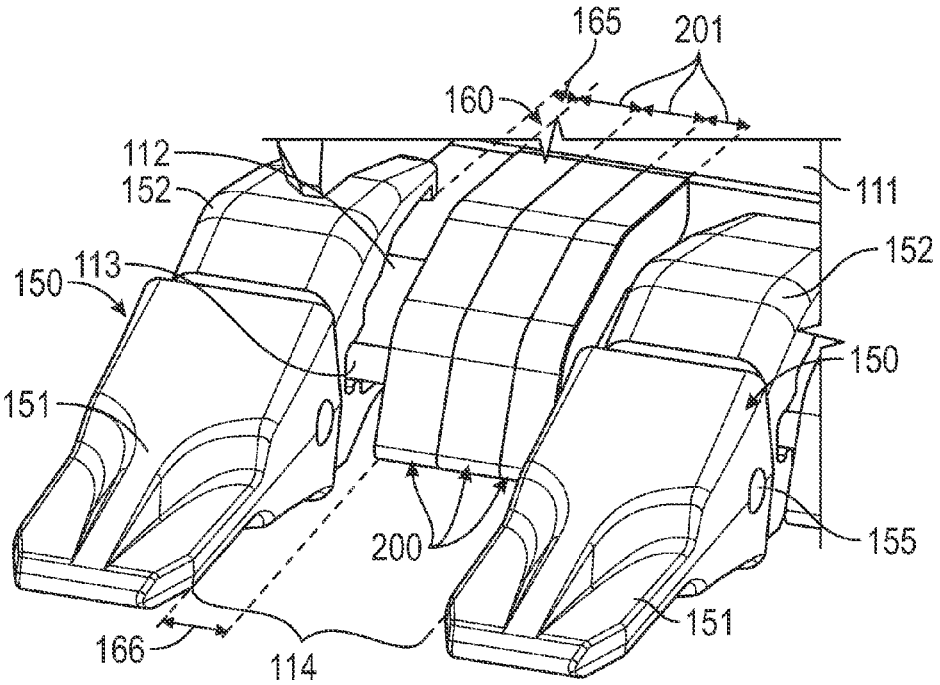
FIG. 2 is a perspective view of a portion of the bucket of FIG. 1.

FIG. 2 is a perspective view of a portion of the bucket 100 of FIG. 1. Each edge protection system 160 includes multiple edge protection segments 200. In the embodiment illustrated in FIG. 2, edge protection system 160 includes three edge protection segments 200. In other embodiments, edge protection system 160 includes two or more edge protection segments 200.

Each edge protection segment 200 includes a width 201. The combined widths 201 of the edge protection segments 200 determine how much of base edge gap 114 is covered by edge protection system 160. The width 201 of each edge protection segment 200 may be selected from multiple predetermined widths, sizes, or values. In some embodiments, the predetermined widths may each be less than half of base edge gap 114, the distance between adjacent tooth assemblies 150. In one embodiment, the predetermined widths are lengths up to 6 centimeters (2.36 inches). In another embodiment, the predetermined widths are from 2 centimeters (0.79 inches) to 6 centimeters (2.36 inches). In yet another embodiment, the predetermined widths are from 2.5 (0.98 inches) centimeters to 5.5 centimeters (2.17 inches). In a further embodiment, the predetermined widths are from 2.54 centimeters (1 inch) to 5.08 centimeters (2 inches). In yet a further embodiment, the predetermined widths are from 3.81 centimeters (1.5 inches) to 5.08 centimeters (2 inches).

In one embodiment, the width 201 of each edge protection segment 200 is selected from a first predetermined width of 5.08 centimeters (2 inches) and a second predetermined width of 3.81 centimeters (1.5 inches). In another embodiment, the width 201 of each edge protection segment 200 is also selected from a third predetermined width of 2.54 centimeters (1 inch). Other predetermined widths for width 201 may also be used, such as 2 centimeters (0.79 inches), 2.5 centimeters (0.98 inches), 3 centimeters (1.18 inches), 3.5 centimeters (1.38 inches), 4 centimeters (1.57 inches), 4.5 centimeters (1.77 inches), 5 centimeters (1.97 inches), 5.5 centimeters (2.17 inches), 6 centimeters (2.36 inches), 6.35 centimeters (2.5 inches), 7.62 centimeters (3 inches), 8.89 centimeters (3.5 inches), 10.16 centimeters (4 inches), 11.43 centimeters (4.5 inches), and 12.7 centimeters (5 inches).

Bucket 100 may include an adapter clearance 165 between each adapter portion 152 and each edge protection system 160, and a tooth clearance 166 between each tooth portion 151 and each edge protection system 160. In some embodiments, adapter clearance 165 is at least 1.5 centimeters (0.6 inches) and in other embodiments is from 1.5 centimeters (0.6 inches) to 2.0 centimeters (0.8 inches). While, in some embodiments, tooth clearance 166 is at least 2.5 centimeters (1.0 inch) and in other embodiments is from 2.5 centimeters (1.0 inch) to 3.0 centimeters (1.2 inches). Adapter clearance 165 and tooth clearance 166 may prevent an edge protection system 160 and an adjacent tooth assembly 150 from contacting or rubbing, damaging both the edge protection system 160 and the tooth assembly 150.

Figure 3:
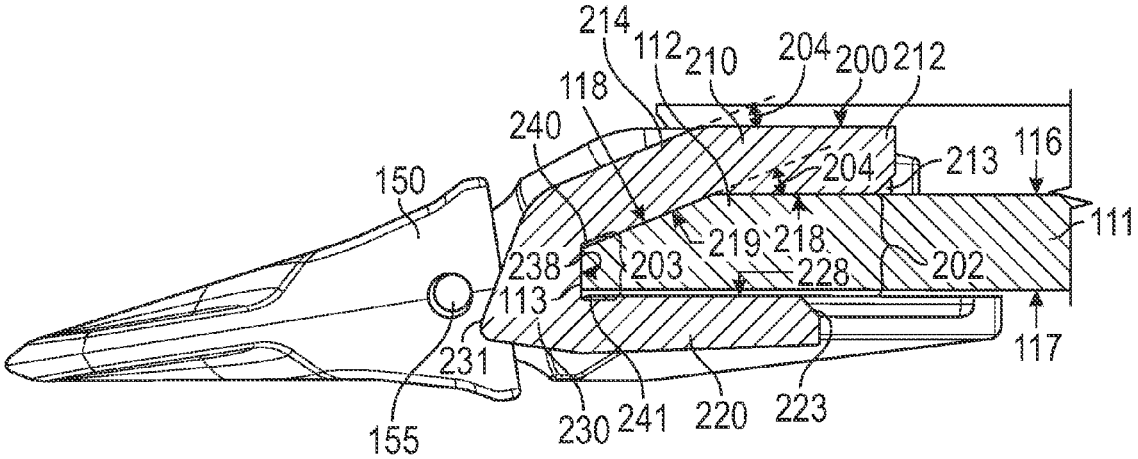
FIG. 3 is a cross-section of a portion of the bucket of FIG. 1.

FIG. 3 is a cross-section of the edge plate 111 of the bucket 100 of FIG. 1. Edge plate 111 also includes a base bevel 112, interior surface 116, exterior surface 117, and bevel surface 118. Base bevel 112 is adjacent base edge 113. Base bevel 112 narrows from a general thickness of edge plate 111 to the thickness or height of base edge 113. Interior surface 116 is the surface of edge plate 111 located in the interior of bucket 100. Exterior surface 117 is the surface of edge plate 111 located on the exterior of bucket 100, opposite interior surface 116. Exterior surface 117 may be parallel to interior surface 116.

Bevel surface 118 is the angled surface of base bevel 112 adjacent interior surface 116 and base edge 113. Bevel surface 118 may be angled relative interior surface 116 and exterior surface 117. Bevel surface 118 may be angled from twenty degrees to forty degrees relative to interior surface 116 and exterior surface 117. In one embodiment, bevel surface 118 is angled 22.5 degrees relative to interior surface 116 and exterior surface 117. In another embodiment, bevel surface 118 is angled 35 degrees relative to interior surface 116 and exterior surface 117.

Each edge protection segment 200 includes a wedge portion 230, an interior leg 210 and an exterior leg 220. Wedge portion 230 is configured to be adjacent base edge 113. Wedge portion 230 may include a wedge or triangular prism shape. Wedge portion 230 may include a leading edge 231 and an edge mating surface 238. Leading edge 231 may be a vertex of the wedge shape and may be located opposite or distal to edge mating surface 238. Edge mating surface 238 is configured to be adjacent base edge 113 and may be parallel to base edge 113.

Interior leg 210 extends from wedge portion 230 adjacent to edge mating surface 238, covering an interior portion of edge plate 111 including a portion of base bevel 112. Interior leg 210 includes bevel portion 214 and end portion 212. Bevel portion 214 may extend at an angle congruent to bevel surface 118. Bevel portion 214 may include bevel mating surface 219. Bevel mating surface 219 may be the inner surface of bevel portion 214 configured to contact bevel surface 118 and may be parallel to bevel surface 118.

End portion 212 extends from bevel portion 214 away from wedge portion 230. End portion 212 includes interior mating surface 218. Interior mating surface 218 is the inner surface of end portion 212 configured to contact interior surface 116 and may be parallel to interior surface 116. Bevel mating surface 219 is canted or angled acutely relative to interior mating surface 218 at bevel angle 204. Bevel angle 204 may be from 20 to 40 degrees. In one embodiment, bevel angle 204 is 22.5 degrees. In another embodiment, bevel angle 204 is 35 degrees. In certain embodiments, bevel angle 204 may be substantially equal to the angle of bevel surface 118 relative to interior surface 116 and exterior surface 117.

End portion 212 may include an interior weld bevel 213. Interior weld bevel 213 is located adjacent interior mating surface 218, opposite and distal to bevel mating surface 219.

Exterior leg 220 extends from wedge portion 230 adjacent edge mating surface 238 and on the opposite side of edge mating surface 238 from interior leg 210. Exterior leg 220 covers an exterior portion of edge plate 111. Exterior leg 220 may extend generally parallel to end portion 212. Exterior leg 220 includes exterior mating surface 228. Exterior mating surface 228 is the inner surface of exterior leg 220 configured to contact exterior surface 117 and may be generally parallel to exterior surface 117. Exterior mating surface 228 may also be generally parallel to interior mating surface 218. Interior mating surface 218 is offset from and facing exterior mating surface 228. Bevel mating surface 219 is canted or angled acutely relative to exterior mating surface 228. Bevel mating surface 219 may be angled relative to exterior mating surface 228 at bevel angle 204. In certain embodiments, the angle of bevel mating surface 219 relative to exterior mating surface 228 may be substantially equal to the angle of bevel surface 118 relative to interior surface 116 and exterior surface 117.

Exterior mating surface 228 and bevel mating surface 219 are each adjacent edge mating surface 238 being located at opposite ends of edge mating surface 238 or distal to one another.

Exterior leg 220 may include an exterior weld bevel 223. Exterior weld bevel 223 is located adjacent exterior mating surface 228, opposite and distal to edge mating surface 238. Edge protection segments 200 are metalurgically bonded or welded to edge plate 111. Interior weld bevel 213 and exterior weld bevel 223 may facilitate the bonding or welding.

Each edge protection segment 200 may also include a first recess 240 and a second recess 241. First recess 240 is located between edge mating surface 238 and bevel mating surface 219. First recess 240 may be an undercut and may extend into bevel portion 214. Second recess 241 is located between edge mating surface 238 and exterior mating surface 228. Second recess 241 may be an undercut and may extend into exterior leg 220. Along with first recess 240 and second recess 241, edge mating surface 238 may be slightly offset from base edge 113 when edge protection segment 200 is coupled to edge plate 111. Interior mating surface 218 may also be slightly offset from interior surface 116 when edge protection segment 200 is coupled to base 110.

The outer edges between each portion or leg of each edge protection segment 200 may be rounded. The leading edge 231 may also be rounded.

Each edge protection segment 200 includes a base gap 202 and an edge gap 203. Base gap 202 is the distance between end portion 212 and exterior leg 220, and more particularly the distance between interior mating surface 218 and exterior mating surface 228. Base gap 202 is at least the thickness of edge plate 111 and is configured to receive edge plate 111. Edge gap 203 is the distance from the intersection between edge mating surface 238 and bevel mating surface 219, and the intersection between edge mating surface 238 and exterior mating surface 228. Edge gap 203 is at least the height of base edge 113 and is configured to receive base edge 113. Edge gap 203 may include first recess 240 and second recess 241.

Figure 4:
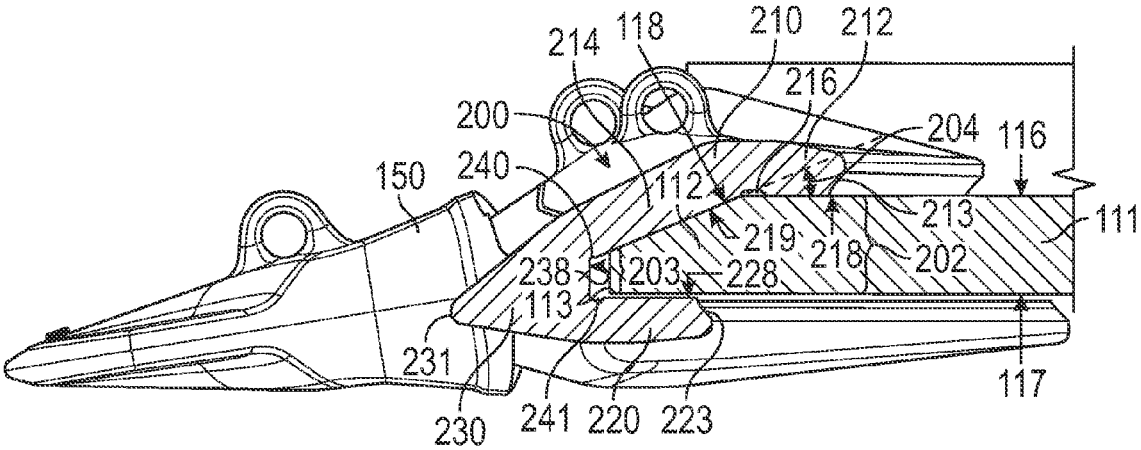
FIG. 4 is a cross-section of an alternate embodiment of a portion of the bucket of FIG. 1.

In the embodiment illustrated in FIG. 3, bevel portion 214, end portion 212, and exterior leg 220 generally include a cuboid or a right rectangular prism shape. FIG. 4 is a cross-section of an alternate embodiment of a portion of the bucket 100 of FIG. 1. In the embodiment illustrated in FIG. 4, the outer surfaces of end portion 212 and exterior leg 220 are curved or rounded rather than including a cuboid or a right rectangular prism shape. The embodiment in FIG. 4 also includes an undercut 216 located at the intersection of bevel portion 214 and end portion 212 adjacent bevel mating surface 219 and interior mating surface 218.

In the embodiment illustrated in FIG. 3, the tooth portion 151 of each tooth assembly 150 includes a pinhole 155. A rod or a pin may extend through each tooth portion 151 and between each tooth assembly 150. The wedge portion 230 and leading edge 231 of each edge protection segment 200 may be configured so as to not overlap with pinhole 155, or interfere with the rod or pin. In this embodiment, the angle between the surfaces adjacent leading edge 231 is between 40 degrees and 120 degrees. The height of wedge portion 230, the length of a line extending from leading edge 231 to where the line would intersect and be perpendicular to edge mating surface 238, is from 4 centimeters (1.57 inches) to 8 centimeters (3.15 inches).

In the embodiment illustrated in FIG. 4, the tooth portion 151 of each tooth assembly 150 does not include a pinhole. The angle between the surfaces adjacent leading edge 231 in this embodiment is from 45 degrees and 90 degrees. The height of wedge portion 230 in this embodiment is from 8 centimeters (3.15 inches) to 12 centimeters (4.72 inches). While the embodiments in FIGS. 3 and 4 depict specific angles and heights for the wedge portion 230, other acute angles and heights may also be used.

Figure 5:
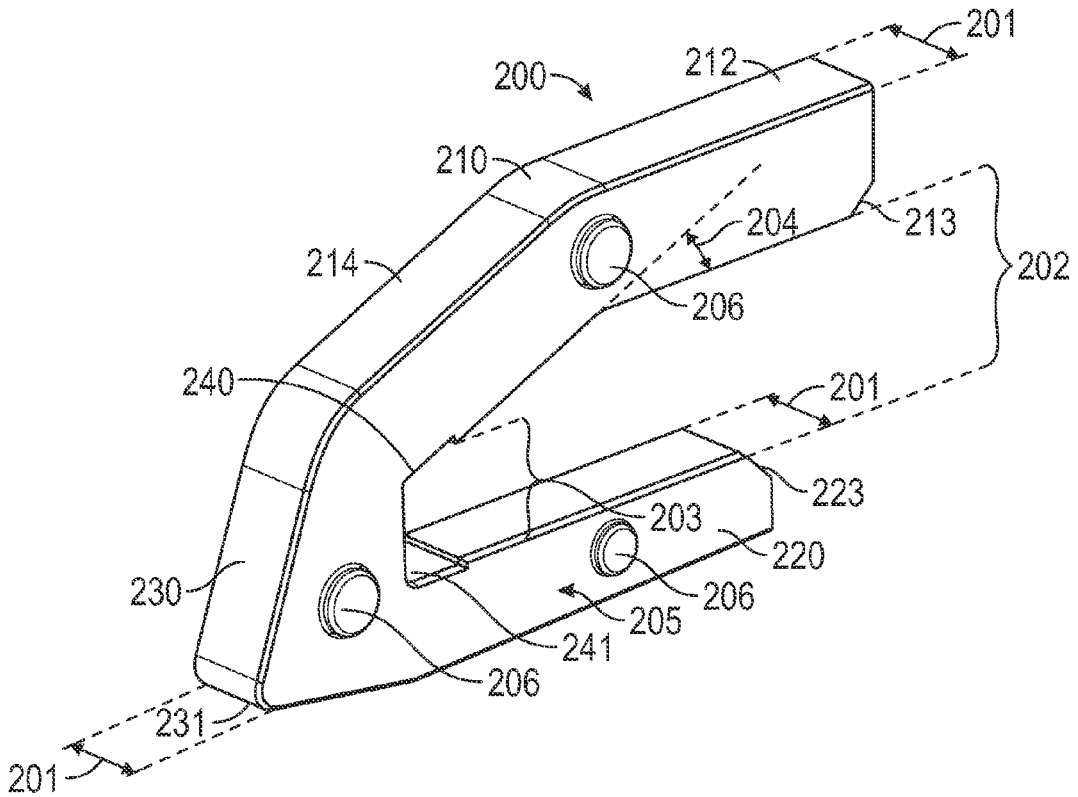
FIG. 5 is a perspective view of an edge protection segment of the bucket of FIG. 1.
Figure 6:
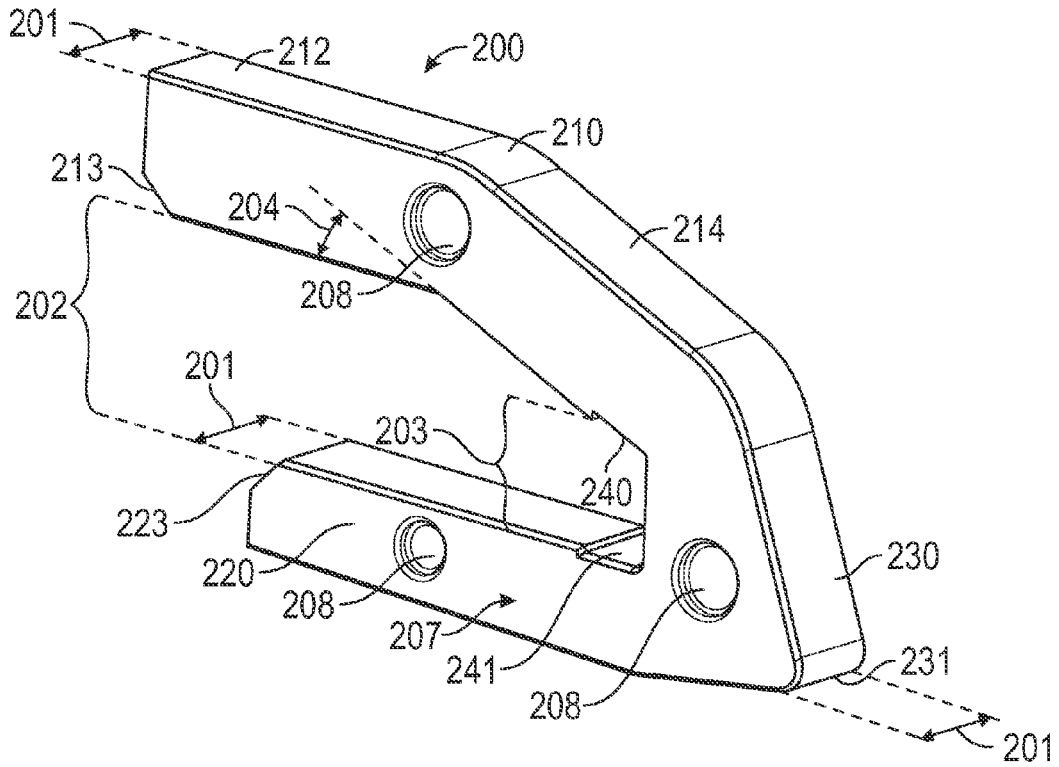
FIG. 6 is a perspective view of the edge protection segment of FIG. 5 from an alternate angle.

FIG. 5 is a perspective view of an edge protection segment 200 of the bucket 100 of FIG. 1. FIG. 6 is a perspective view of the edge protection segment 200 of FIG. 5 from an alternate angle. Referring to FIGS. 5 and 6, each edge protection segment 200 includes a first side 205 (shown in FIG. 5) and a second side 207 (shown in FIG. 6). First side 205 and second side 207 include the side surfaces of interior leg 210, exterior leg 220, and wedge portion 230. First side 205 and second side 207 are offset from one another, or oppositely disposed and lateral to one another. In some embodiments, first side and second side are parallel. First side 205 and second side 207 may be perpendicular to interior mating surface 218, bevel mating surface 219, and exterior mating surface 228.

Edge protection segments 200 may include an interlock mechanism to align or connect adjacent edge protection segments 200. The interlock mechanism of a first edge protection segment 200 may be mated to the interlock mechanism of a second edge protection segment 200. In the embodiment illustrated in FIGS. 5 and 6, the interlock mechanism includes interlocking projections 206 and interlocking depressions 208. One or more interlocking projections 206 and a matching number of interlocking depressions 208 may be used. In the embodiment illustrated, three interlocking projections 206 extend from first side 205 and three corresponding interlocking depressions 208 extend into the second side 207.

Each interlocking projection 206 and the corresponding interlocking depression 208 include the same shape, where the interlocking depression 208 is a negative shape of the interlocking projection 206. The tolerances of the interlocking projections 206 and the interlocking depressions 208 may be configured and sized to ensure that interlocking projections 206 can be inserted into corresponding interlocking depressions 208. In the embodiment illustrated in FIGS. 5 and 6, interlocking projections 206 and interlocking depressions 208 include a right circular cylinder shape. Interlocking projections 206 and interlocking depressions 208 may also be formed from prisms and right prisms, such as triangular prisms, cuboids, pentagonal prisms, etc.

While the embodiments shown in FIGS. 5 and 6 depict the interlocking projections 206 extending from first side 205 and the interlocking depressions 208 extending into second side 207, in other embodiments, both first side 205 and second side 207 may include both interlocking projections 206 and interlocking depressions 208 with corresponding interlocking projections 206 or interlocking depressions 208 on the opposite surface.

In some embodiments, each interlocking projection 206 is a ridge extending along either the first side 205 or the second side 207 while each corresponding interlocking depression 208 is a groove. In one embodiment, each edge protection segment 200 includes a single ridge and a single groove.

In some embodiments, the interlock mechanisms include a dovetail protruding from the first side 205 or the second side 207 and a dovetail slot that corresponds to the dovetail of an adjacent edge protection segment 200. Other interlock mechanisms such as slots with corresponding inserts to link two edge protection segments 200 together may also be used.

One or more of the above components (or their subcomponents) may be made from alloy, steel, or cast iron.

INDUSTRIAL APPLICABILITY

The buckets and blades of earth working machines and tools can be protected against wear by including ground engaging tools (GET) such as teeth, edge protectors, and other components. GET are attached to the bucket or blade in the areas where the most damaging abrasion and impact may occur during operation of the earth working machines. GET generally serve as wear material that can be removed and replaced once damaged. GET may prevent or reduce the damage to the buckets and blades and increase the operating life of the buckets and blades, preventing early replacement of the buckets and blades. Replacing GET rather than the buckets and blades may considerably reduce operating costs, especially in situations that include digging harder materials such as granite or stone.

As described herein, edge protection system 160 includes multiple edge protection segments 200 with the width 201 of each segment being selected from two or more predetermined widths. Edge protection system 160 is a universal system that can be used to protect base edge 113 between tooth assemblies 150 for any length of base edge gap 114. The length of base edge gap 114 may be used to determine the number of edge protection segments 200 to use and which predetermined widths for the width 201 of each edge protection segment 200 should be used.

Buckets 100 may include varying sizes with varying configurations of tooth assemblies 150. Edge protection system 160 may limit the number of different edge protection segments 200 that need to be manufactured to the number of predetermined widths, rather than producing a single edge protector for each conceivable configuration. In some embodiments, the number of edge protection segments 200 may be two or three. Edge protection system 160 may also prevent the need for a customer to cut down longer stock to fit base edge gap 114 prior to installing an edge protector.

While installing edge protection system 160 onto edge plate 111, interlock mechanisms, such as interlocking projections 206 and interlocking depressions 208 may help align adjacent edge protection segments 200 including the leading edges 231, the interior legs 210, and the exterior legs 220. The interlocking projections 206 and interlocking depressions 208 may guide the edge protection segments 200 into proper alignment as the edge protection segments 200 are brought together. Aligning the edge protection segments 200 may reduce or prevent wear or stress on each edge protection segment 200. For example, a misaligned edge protection segment 200 may have an edge or portion exposed that may contact the ground prior to other portions and edge protection segments 200, which may lead to increased wear and stress on that edge protection segment 200.

During manufacturing, internal corners such as the corners adjacent edge mating surface 238 may accumulate excess material. This excess material may prevent base edge 113 from fitting into edge gap 203. First recess 240 and second recess 241 may provide relief for the excess material to ensure base edge 113 can fit into edge gap 203. First recess 240 and second recess 241 may also round the corners adjacent edge mating surface 238, which may reduce stress concentrations at those locations. Interior leg undercut 216 may similarly provide relief for any excess material and reduce stress concentrations at the inner corner between end portion 212 and bevel portion 214.

The preceding detailed description is merely exemplary in nature and is not intended to limit the invention or the application and uses of the invention. The described embodiments are not limited to use in conjunction with a particular type of bucket for earth working machines. Hence, although the present disclosure, for convenience of explanation, depicts and describes a particular bucket, it will be appreciated that the edge protection system in accordance with this disclosure can be implemented in various other configurations including combinations of various aspects of the embodiments disclosed, can be used with various other types of buckets and earth working machines, and can be used in other types of systems and machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An edge protection segment for an edge protection system of a ground engaging implement for an earth working machine, the ground engaging implement including a wrapper plate, an edge plate with a base edge, an interior surface, an exterior surface, and a base bevel including a bevel surface adjacent the base edge and the interior surface, the ground engaging implement also including tooth assemblies configured to attach to the edge plate at the base edge, the tooth assemblies being spaced apart along the base edge, the edge protection segment comprising:

a first side;

a second side oppositely disposed and lateral to the first side, a width being the distance between the first side and the second side;

a wedge portion with a triangular prism shape extending between the first side and the second side;

an exterior leg extending from the wedge portion between the first side and the second side;

an interior leg extending from the wedge portion between the first side and the second side, the interior leg including a bevel portion extending from the wedge portion, angled away from the exterior leg and having a planar bevel mating surface on an inner surface of the bevel portion, and an end portion extending from the bevel portion away from the wedge portion, the end portion being canted relative to the bevel portion and having an interior mating surface extending from the bevel mating surface and being canted relative to the bevel mating surface at the same angle as the end portion; and an interlock mechanism configured to align the edge protection segment with an adjacent edge protection segment, the interlock mechanism including an interlocking projection extending from the first side, and an interlocking depression extending in from the second side, the interlocking depression being a negative shape of the interlocking projection.

2. The edge protection segment of claim 1, wherein the width is selected from a plurality of predetermined widths.

3. The edge protection segment of claim 2, wherein the plurality of predetermined widths include a first predetermined width of 3.81 centimeters and a second predetermined width of 5.08 centimeters.

4. The edge protection segment of claim 3, wherein the plurality of predetermined widths include a third predetermined width of 2.54 centimeters.

5. The edge protection segment of claim 1, wherein the interlocking projection and the interlocking depression are right circular cylinders.

6. The edge protection segment of claim 1, wherein the wedge portion includes a leading edge at a vertex of the triangular prism shape, and an edge mating surface opposite the leading edge and adjacent the bevel mating surface, extending between the first side and the second side; and wherein the exterior leg includes an exterior mating surface adjacent to the edge mating surface, offset from and facing the interior mating surface.

7. The edge protection segment of claim 6, further comprising:

a first recess located between the bevel mating surface and the edge mating surface; and a second recess located between the exterior mating surface and the edge mating surface.

8. The edge protection segment of claim 6, wherein the interior leg includes an undercut between the bevel mating surface and the interior mating surface.

9. The edge protection segment of claim 6, wherein the interior leg includes an interior weld bevel adjacent the interior mating surface distal to the bevel mating surface and the exterior leg includes an exterior weld bevel adjacent the exterior mating surface distal to the edge mating surface.

10. An edge protection system for a bucket of an earth working machine, the bucket including a wrapper plate, an edge plate with a base edge, an interior surface, an exterior surface, and a base bevel including a bevel surface adjacent the base edge and the interior surface, the bucket also including tooth assemblies configured to attach to the edge plate at the base edge, the tooth assemblies being spaced apart along the base edge, the edge protection system comprising:

a first edge protection segment including a first side, a second side offset from the first side, a first width between the first side and the second side, the first width being selected from a plurality of predetermined widths, a first wedge portion including a first leading edge extending from the first side to the second side, and a first edge mating surface opposite the first leading edge extending from the first side to the second side, a first exterior leg extending from the first wedge portion, the first exterior leg including a first exterior mating surface extending from the first side to the second side, adjacent to the first edge mating surface, and a first interior leg extending from the first wedge portion, the first interior leg including a bevel portion extending from the wedge portion, angled away from the exterior leg and having a first bevel mating surface on an inner surface of the bevel portion, the first bevel mating surface extending from the first side to the second side, adjacent first edge mating surface opposite the first exterior mating surface, and an end portion extending from the bevel portion away from the wee portion the end portion being canted relative to the bevel portion and having a first interior mating surface extending from the first side to the second side and extending from the bevel mating surface, offset from and facing the exterior mating surface and adjacent the first bevel mating surface, the first bevel mating surface being canted relative to the first bevel mating surface at the same angle as the end portion; and a second edge protection segment including a third side, a fourth side offset from the third side, a second width between the third side and the fourth side, the second width being selected from the plurality of predetermined widths, a second wedge portion including a second leading edge extending from the third side to the fourth side, and a second edge mating surface opposite the second leading edge extending from the third side to the fourth side, a second exterior leg extending from the second wedge portion, the second exterior leg including a second exterior mating surface extending from the third side to the fourth side, adjacent to the second edge mating surface, a second interior leg extending from the second wedge portion, the second interior leg including a second bevel mating surface extending from the third side to the fourth side, adjacent the second edge mating surface opposite the second exterior mating surface, and a second interior mating surface extending from the third side to the fourth side, offset from and facing the second exterior mating surface and adjacent the second bevel mating surface, the second bevel mating surface being angled relative to the second interior mating surface at angle; and wherein the first edge protection segment includes a first interlocking mechanism and the second edge protection segment includes a second interlocking mechanism, wherein the first interlocking mechanism and the second interlocking mechanism are configured to align the first edge protection segment and the second edge protection segment.

11. The edge protection system of claim 10, wherein the plurality of predetermined widths are from 2 centimeters to 6 centimeters.

12. The edge protection system of claim 10, wherein the plurality of predetermined widths include a first predetermined width of 3.81 centimeters and a second predetermined width of 5.08 centimeters.

13. The edge protection system of claim 10, wherein the first interlocking mechanism includes an interlocking projection extending from the first side and the second interlocking mechanism includes an interlocking depression extending from the fourth side with the interlocking projection sized to fit into the interlocking depression.

14. The edge protection system of claim 13, wherein the interlocking projection and the interlocking depression are right circular cylinders.

15. A bucket for an earth working machine, the bucket comprising:

a wrapper plate;

an edge plate metalurgically bonded to the wrapper plate, the edge plate including a base edge located at one end of the edge plate, and a base bevel located adjacent the base edge;

a plurality of tooth assemblies connected to the edge plate and spaced apart along the base edge, each of the plurality of tooth assemblies including an adapter portion connected to the edge plate and a tooth portion coupled to the adapter portion and extending away from the edge plate; and a plurality of edge protection systems, two or more of the plurality of edge protection systems being adjacent to each other and located between adjacent tooth assemblies, each of the plurality of edge protection systems including a first edge protection segment including a first side, a second side offset from the first side, a first width being the distance between the first side and the second side, the first width being selected from a plurality of predetermined widths, each predetermined width being less than half the distance between adjacent tooth assemblies, a first wedge portion covering the base edge of the edge plate, a first interior leg extending from the first wedge and covering a first interior portion of the edge plate including a first portion of the base bevel, the first interior leg including a bevel portion extending from the first wedge portion, angled away from the exterior leg and having a first bevel mating surface on an inner surface of the bevel portion, the first bevel mating surface extending from the first side to the second side, adjacent first edge mating surface opposite the first exterior mating surface, and an end portion extending from the bevel portion away from the wedge portion, the end portion being canted relative to the bevel portion and having a first interior mating surface extending from the first side to the second side and extending from the bevel mating surface, offset from and facing the exterior mating surface and adjacent the first bevel mating surface, the first bevel mating surface being canted relative to the first bevel mating surface at the same angle as the end portion, a first exterior leg covering a first exterior portion of the edge plate opposite the first interior portion of the edge plate, and a second edge protection segment adjacent the first edge protection segment, the second edge protection segment including a third side, a fourth side offset from the third side, a second width between the third side and the fourth side, the second width being selected from the plurality of predetermined widths, a second interior leg covering a second interior portion of the edge plate including a second portion of the base bevel, and a second exterior leg covering a second exterior portion of the edge plate opposite the second interior portion of the edge plate;

wherein the first edge protection segment includes a first interlocking mechanism and the second edge protection segment includes a second interlocking mechanism, wherein the first interlocking mechanism and the second interlocking mechanism are mated.

16. The bucket of claim 15, wherein the plurality of predetermined widths include a first predetermined width of 3.81 centimeters and a second predetermined width of 5.08 centimeters.

17. The bucket of claim 15, wherein each of the plurality of edge protection systems is spaced apart from each of the plurality of tooth assemblies by at least 2.5 centimeters.

18. The bucket of claim 15, wherein the first edge protection segment and the second edge protection segment are welded to the edge plate.

* * * * *